US006688591B2

(12) United States Patent
Larsen et al.

(10) Patent No.: US 6,688,591 B2
(45) Date of Patent: Feb. 10, 2004

(54) APPARATUS AND METHOD FOR REMOVING SLIP SHEETS

(75) Inventors: David B. Larsen, Woburn, MA (US); Jeffrey Scott Carter, Osceola, IN (US)

(73) Assignees: Agfa Corporation, Wilmington, MA (US); K & F International, Granger, IN (US)

( * ) Notice: Subject to any disclaimer, the term of this patent is extended or adjusted under 35 U.S.C. 154(b) by 41 days.

(21) Appl. No.: 10/117,411

(22) Filed: Apr. 5, 2002

(65) Prior Publication Data

US 2003/0189281 A1 Oct. 9, 2003

(51) Int. Cl.[7] ..... B65H 29/66
(52) U.S. Cl. ..... 271/98; 271/11
(58) Field of Search ..... 271/11, 12, 97, 271/98, 103, 106, 112; 346/134

(56) References Cited

U.S. PATENT DOCUMENTS 3,158,367 A * 11/1964 Tarbuck ..... 271/97
3,168,307 A 2/1965 Walton et al.
3,168,308 A 2/1965 Walton et al.
4,364,550 A 12/1982 Hynes
4,708,333 A 11/1987 Servi et al.
4,763,890 A 8/1988 Zimmerman et al.
4,802,662 A 2/1989 Hobbelt et al.
4,968,018 A 11/1990 Hoehne et al.
5,046,712 A 9/1991 Clapp et al.
6,084,602 A * 7/2000 Rombult et al. ..... 346/134

* cited by examiner

*Primary Examiner*—Christopher P. Ellis
*Assistant Examiner*—Mark A. Deuble
(74) *Attorney, Agent, or Firm*—John A. Merecki; Robert A. Sabourin

(57) ABSTRACT

The present invention provides an apparatus and method for removing a slip sheet from the top of a stack of printing plates. The apparatus includes a wing for covering an end section of the slip sheet, an air manifold coupled to an end of the wing, the air manifold including a plurality of orifices for directing streams of air along an underside of the wing to lift the end portion of the slip sheet off of the printing plate and toward the underside of the wing, a plurality of idler rollers rotatably mounted about the air manifold, and a clamping bar mounted to the wing for selectively pinching the lifted end section of the slip sheet against the underside of the wing, thereby capturing the slip sheet.

27 Claims, 11 Drawing Sheets

APPARATUS AND METHOD FOR REMOVING SLIP SHEETS

FIELD OF THE INVENTION

The present invention is in the field of imaging systems. More particularly, the present invention provides an apparatus and method for removing a slip sheet from the top of a stack of printing plates.

BACKGROUND OF THE INVENTION

A cassette is often used to supply a stack of unexposed printing plates to an external drum imaging system. Each printing plate may comprise one or more layers supported by a support substrate, and one or more image recording (i.e., "imageable") layers such as a photosensitive, radiation sensitive, or thermally sensitive layer, or other chemically or physically alterable layers. Printing plates are available in a wide variety of sizes, typically ranging, for example, from 9"×12", or smaller, to 58"×80", or larger. The printing plates are normally supplied in stacks of ten to one hundred, depending upon plate thickness and other factors. Interleaf sheets, commonly referred to as "slip sheets," are usually positioned between the printing plates to protect the emulsion side of the printing plates from physical damage (e.g., scratches), which could render a printing plate unusable for subsequent printing. The slip sheets are typically formed from a porous material, such as paper.

Many different techniques have been used to remove a slip sheet from the top of a stack of printing plates to provide access to an underlying unexposed printing plate. For example, a vacuum system employing a plurality of suction cups has been used to pick up and remove slip sheets. Unfortunately, applying a vacuum through suction cups to a porous slip sheet can cause both the slip sheet and the underlying printing plate to be lifted simultaneously.

SUMMARY OF THE INVENTION

The present invention provides an apparatus and method for removing a slip sheet from the top of a stack of printing plates.

Generally, the present invention provides an apparatus for removing a slip sheet from a surface of a printing plate, comprising:

a wing for covering an end section of the slip sheet, an air manifold coupled to an end of the wing, the air manifold including a plurality of orifices for directing streams of air along an underside of the wing to lift the end portion of the slip sheet off of the printing plate and toward the underside of the wing, a plurality of idler rollers rotatably mounted about the air manifold, and a clamping bar mounted to the wing for selectively pinching the lifted end section of the slip sheet against the underside of the wing, thereby capturing the slip sheet.

The present invention further provides an apparatus for removing a slip sheet from a surface of a printing plate, comprising:

a wing having first and second rotatably coupled sections, a wing drive system for laterally displacing the wing to position the second section of the wing over an end section of the slip sheet, an air manifold coupled to an end of the second section of the wing, the air manifold including a plurality of orifices for directing streams of air along an underside of the second section of the wing to lift the end portion of the slip sheet off of the printing plate and toward the underside of the second section of the wing, a plurality of idler rollers rotatably mounted about the air manifold, and a clamping bar for selectively pinching the lifted end section of the slip sheet against the underside of the second section of the wing, thereby capturing the slip sheet.

The present invention also provides a method for removing a printing plate from a surface of a printing plate, comprising:

providing a wing having an air manifold, wherein the air manifold includes a plurality of orifices, and wherein a plurality of idler rollers are rotatably mounted about the air manifold;

displacing the wing over an end portion of the slip sheet;

displacing the idler rollers into contact with a surface of the slip sheet;

directing streams of air along an underside of the wing to lift the end portion of the slip sheet off of the printing plate and toward the underside of the wing; and clamping the lifted end portion of the slip sheet against the underside of the wing.

BRIEF DESCRIPTION OF THE DRAWINGS

The features of the present invention will best be understood from a detailed description of the invention and embodiments thereof selected for the purpose of illustration and shown in the accompanying drawings in which.

DETAILED DESCRIPTION OF THE INVENTION

Figure 1:
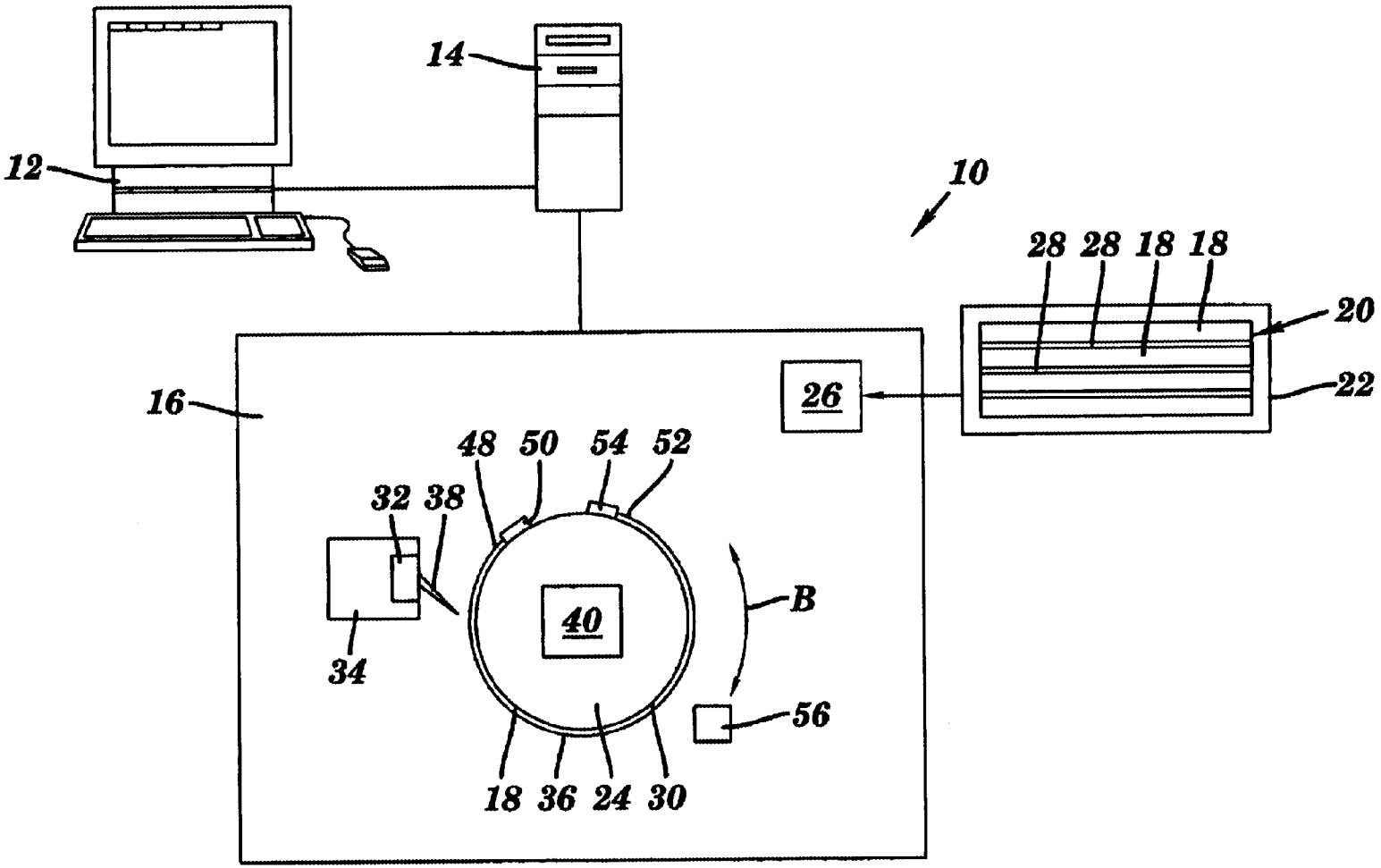
FIG. 1 illustrates an external drum imaging system for recording images onto a printing plate.

The features of the present invention are illustrated in detail in the accompanying drawings, wherein like reference numerals refer to like elements throughout the drawings. Although the drawings are intended to illustrate the present invention, the drawings are not necessarily drawn to scale.

An example of an external drum imaging system 10 is illustrated in FIG. 1. In this example, the imaging system 10 comprises an external drum platesetter configured to record digital data onto a printing plate. Although described below with regard to an external drum platesetter, the slip sheet removal apparatus of the present invention may be used in conjunction with a wide variety of other types of external drum, internal drum, or flatbed imaging systems, including imagesetters and the like, without departing from the intended scope of the present invention.

The imaging system 10 generally includes a front end computer or workstation 12 for the design, layout, editing, and/or processing of digital files representing pages to be printed, a raster image processor (RIP) 14 for further processing the digital pages to provide rasterized page data (e.g., rasterized digital files) for driving an image recorder, and an image recorder or engine, such as an external drum platesetter 16, for recording the rasterized digital files provided by the RIP 14 onto a printing plate 18.

A stack 20 of printing plates 18 is commonly supplied in a cassette 22. A printing plate 18 is removed from the cassette 22 and subsequently mounted on an external drum 24 of the external drum platesetter 16 by an autoloading system 26. The printing plates 18 in the stack 20 are separated from each other by protective slip sheets 28. In an alternate embodiment of the present invention, a plurality of printing plates 18 may be provided in a stack 20 without the use of a cassette. Again, the printing plates 18 in the stack 20 are separated from each other by a slip sheet 28.

Figure 2:
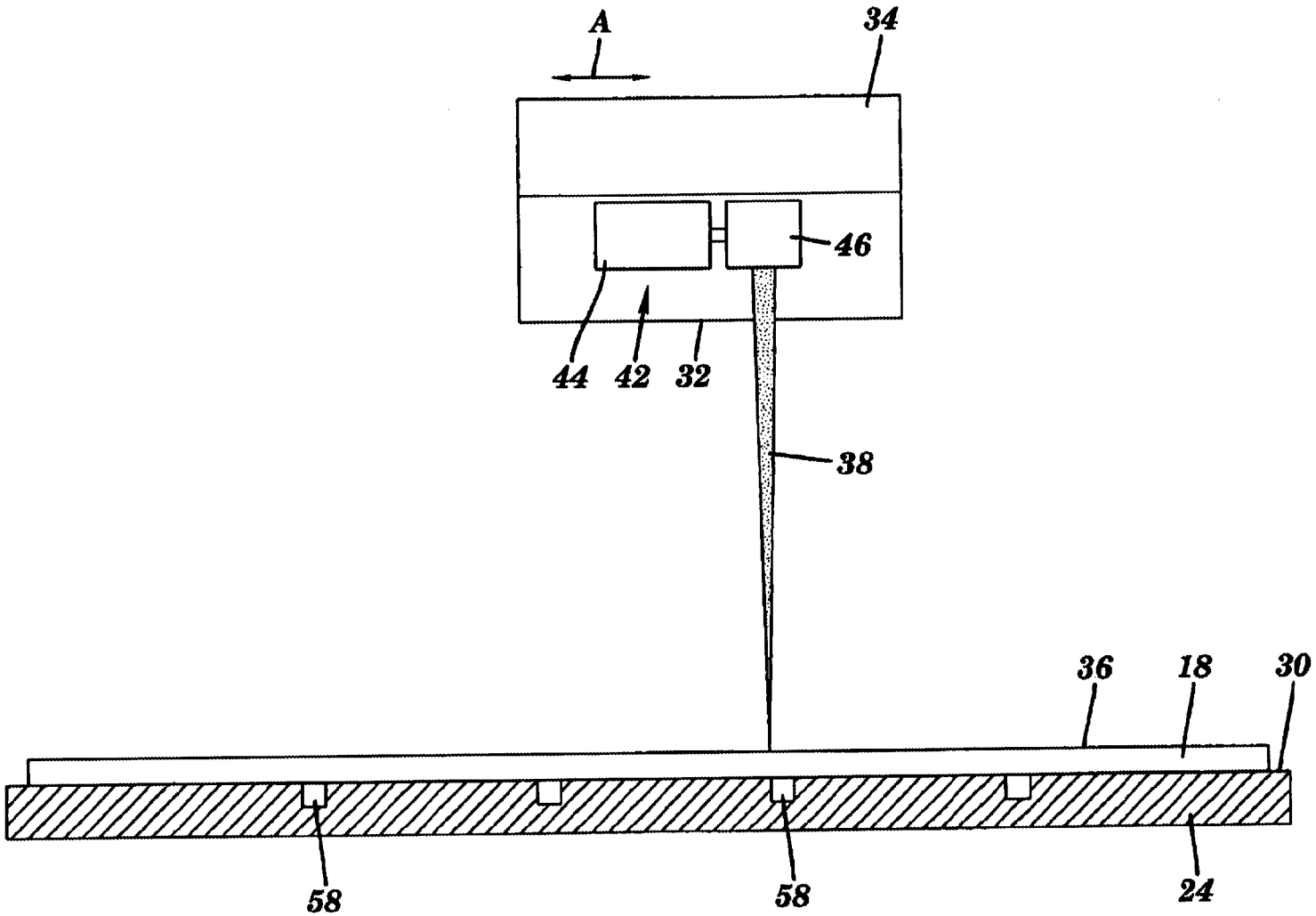
FIG. 2 illustrates an example of an imaging system including a movable optical carriage and scanning system, usable in the external drum imaging system of FIG. 1.

The external drum platesetter 16 includes an external drum 24 having a cylindrical media support surface 30 for supporting the printing plate 18 during imaging. The external drum platesetter 16 further includes a scanning system 32, coupled to a movable carriage 34, for recording digital data onto the imaging surface 36 of the printing plate 18 using a single or multiple imaging beams 38. An example of a scanning system 32 is illustrated in FIG. 2. In particular, the scanning system 32 is displaced by the movable carriage 34 in a slow scan axial direction (directional arrow A) along the length of the rotating external drum 24 to expose the printing plate 18 in a line-wise manner when a single beam is used or in a section-wise manner for multiple beams. Other types of imaging systems may also be used in the present invention.

The external drum 24 is rotated by a drive system 40 in a clockwise or counterclockwise direction as indicated by directional arrow B in FIG. 1. Typically, the drive system 40 rotates the external drum 24 at a rate of about 100–1000 rpm. As further illustrated in FIG. 2, the scanning system 32 typically includes a system 42 for generating the imaging beam or beams 38. The system 42 comprises a light or radiation source 44 for producing the imaging beam or beams 38 (illustrated for simplicity as a single beam), and an optical system 46 positioned between the radiation source 44 and the media support surface 30 for focusing the imaging beam or beams 38 onto the printing plate 18. It should be noted, however, that the system 42 described above is only one of many possible different types of scanning systems that may be used to record image data on the printing plate 18.

In the external drum imaging system 10 shown in FIG. 1, the leading edge 48 of the printing plate 18 is held in position against the media support surface 30 of the external drum 24 by a leading edge clamping mechanism 50. Similarly, the trailing edge 52 of the printing plate 18 is held in position against the media support surface 30 of the external drum 24 by a trailing edge clamping mechanism 54. Other known systems for mounting the printing plate 18 onto the external drum 24 may also be used.

A vacuum source 56 may be used to draw a vacuum through an arrangement of ports and vacuum grooves 58 (see, e.g., FIG. 2) to hold the printing plate 18 against the media support surface 30. The vacuum source 56 may also supply a vacuum to a plate picker 134 (see FIG. 6) of the autoloading system 26 that is configured to remove the top printing plate 18 from the stack 20 of printing plates. A registration system (not shown), comprising, for example, a set of registration pins on the external drum 24, and a plate edge detection system (not shown), may be used to accurately and repeatably position and locate each printing plate 18 on the external drum 24.

Figure 3:
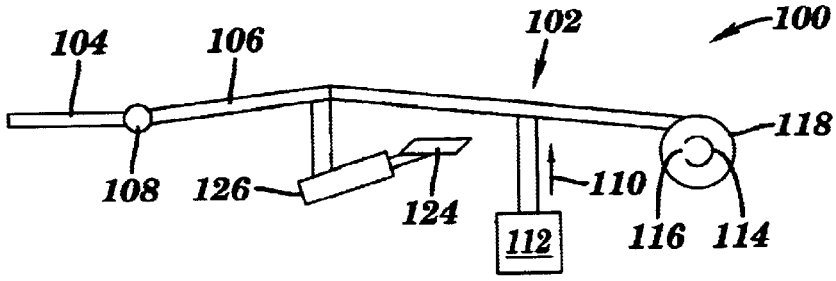
FIG. 3 is a cross-sectional view of a slip sheet removal system in a horizontal position in accordance with the present invention.
Figure 4:
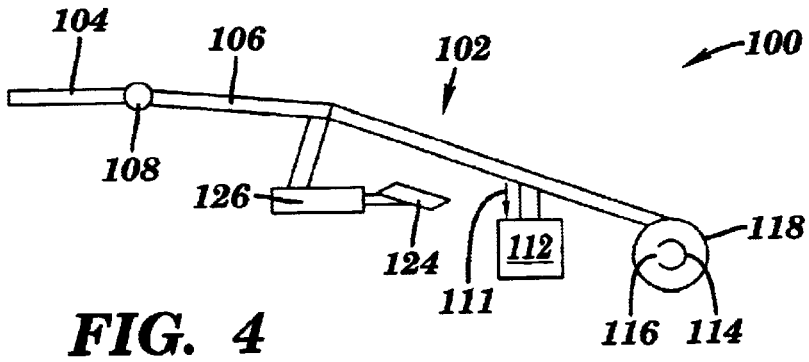
FIG. 4 is a cross-sectional view of a slip sheet removal system in a slip sheet capture position in accordance with the present invention.
Figure 5:
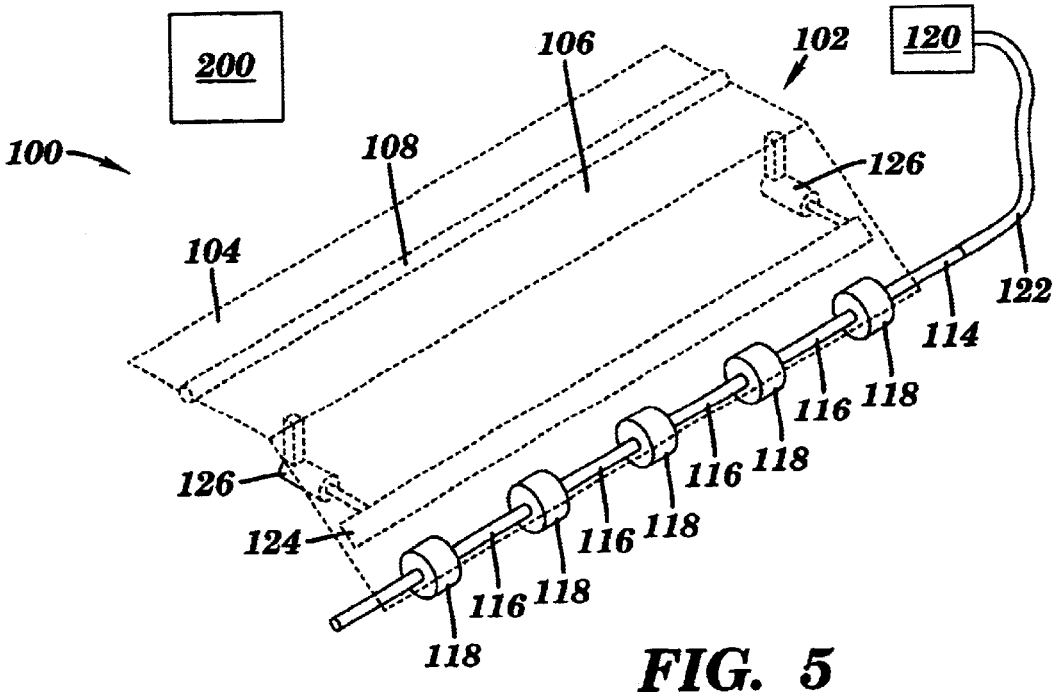
FIG. 5 is a perspective view of the slip sheet removal system of the present invention.

A slip sheet removal system 100 for removing a slip sheet 28 from the top of a stack 20 of printing plates 18 in accordance with the present invention is illustrated in FIG. 3–5. The slip sheet removal system 100 may comprise a portion of the autoloading system 26 illustrated in FIG. 1.

The slip sheet removal system 100 includes a wing 102 having first and second sections 104, 106, which are pivotally connected at hinge 108. The hinge 108 allows the second section 106 of the wing 102 to be displaced between a first, substantially horizontal position (hereafter referred to as the "horizontal" position) as shown in FIG. 3, and a second, angled position (hereafter referred to as the "slip sheet capture" position) as shown in FIGS. 4–5. The wing 102 is moved between the horizontal and the slip sheet capture positions by rotating the second portion 106 of the wing 102 about the hinge 108 as indicated by directional arrows 110 (FIG. 3) and 111 (FIG. 4). The rotation of the wing 102 may be provided by a drive system 112 comprising one or more pneumatic cylinders mounted near the sides of second section 106 of the wing 102. Other drive systems known in the art may also be used to provide the rotation.

A cylindrical air manifold 114, having a plurality of orifices 116 that are directed under the wing 102, is attached in a suitable manner to the end of the second section 106 of the wing 102. A plurality of idler rollers 118 are mounted and spaced apart along the length of the air manifold 114. The idler rollers 118 are free to rotate about the shaft formed by the air manifold 114. A compressed air supply 120 provides compressed air via tube 122 to the air manifold 114.

During operation of the slip sheet removal system 100, as will be presented in greater detail below, compressed air provided by the compressed air supply 120 flows into the air manifold 114 and is directed through the plurality of orifices 116 along the underside of the wing 102. This causes the end of the slip sheet 28 to be lifted off the underlying printing plate 18 in the stack 20 due to the Bernoulli effect (i.e., pressure is lower in a moving fluid than in a stationary fluid). In particular, the high velocity streams of air flowing out of the orifices 116 of the air manifold 114 create a zone of reduced pressure directly under the wing 102. This causes the end of the slip sheet 28 to lift away from the stack 20. The higher pressure under the lifted end of the slip sheet 28 forces the slip sheet 28 toward the underside of the wing 102. The slip sheet 28 is held in this position as long as the air flow through the orifices 116 continues.

A clamping bar 124 is mounted to the underside of the second section 106 of the wing 102. A bar displacing system, comprising, for example, one or more pneumatic cylinders 126 or other suitable displacing means, is provided for displacing the clamping bar 124 toward and away from the underside of the second section 106 of the wing 102. The clamping bar 124 is used to physically capture the end of a slip sheet 28 that has been lifted against the underside of the second section 106 of the wing 102. The clamping bar 124 may be formed using one or more bar segments, and may extend across substantially the entire width of the wing 102 as shown in FIG. 3, or across a portion thereof.

The operation of the slip sheet removal system 100 is described with reference to FIGS. 6–13.

Figure 6:
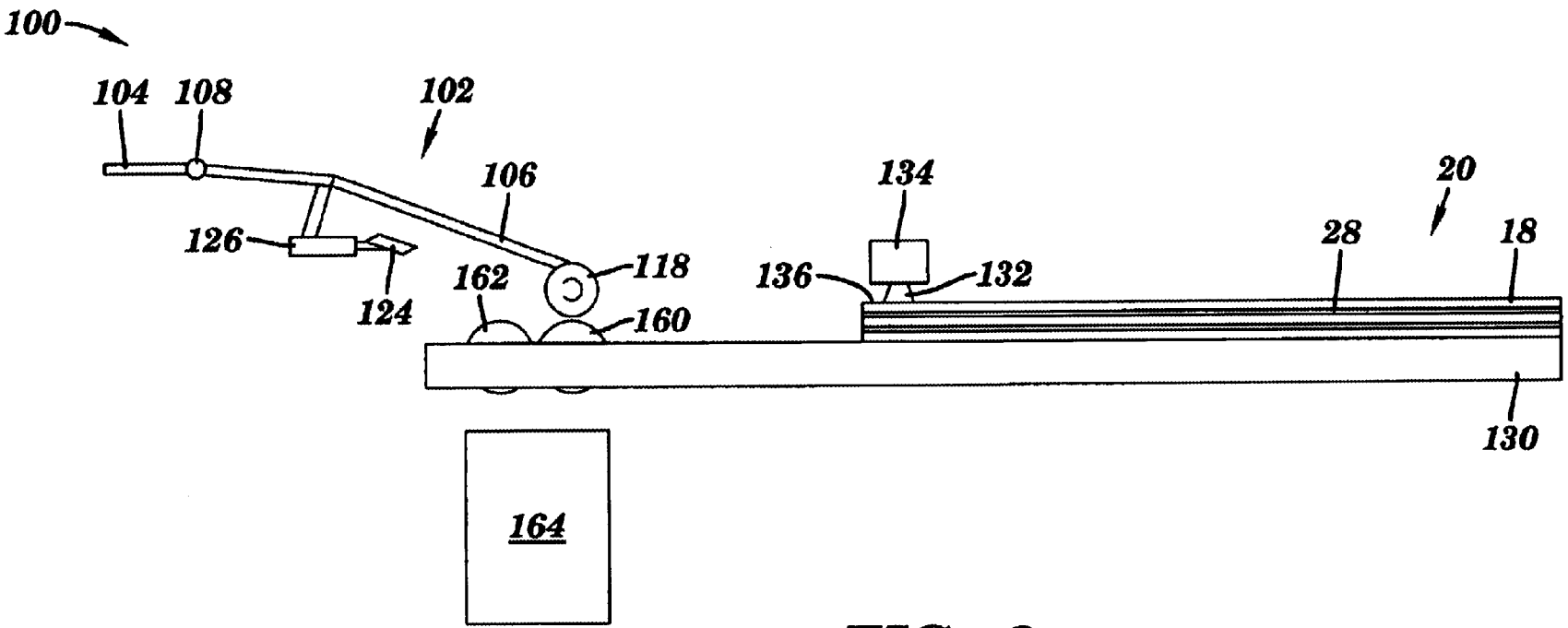
FIGS. 6–13 illustrate the operation of the slip sheet removal system of the present invention.

A stack 20 of printing plates 18 is shown positioned on a support table 130 in FIG. 6. The printing plates 18 in the stack 20 are separated from each other by protective slip sheets 28. The slip sheet removal system 100 of the present invention is positioned to the side of the stack 20 of printing plates 18, with the second section 106 of the wing 102 in the slip sheet capture position. The suction cups 132 of a conventional vacuum-type plate picker 134 are shown in engagement with the end surface 136 of the top printing plate 18 on the stack 20. Other types of available plate pickers could also be used in the practice of the present invention. A plurality of rotatable drive rollers 160, 162, for pulling a captured slip sheet 28 into a bin 164, are provided near the end of the support table 130. The idler rollers 118 of the slip sheet removal system 100 are positioned over the drive rollers 160.

Figure 7:
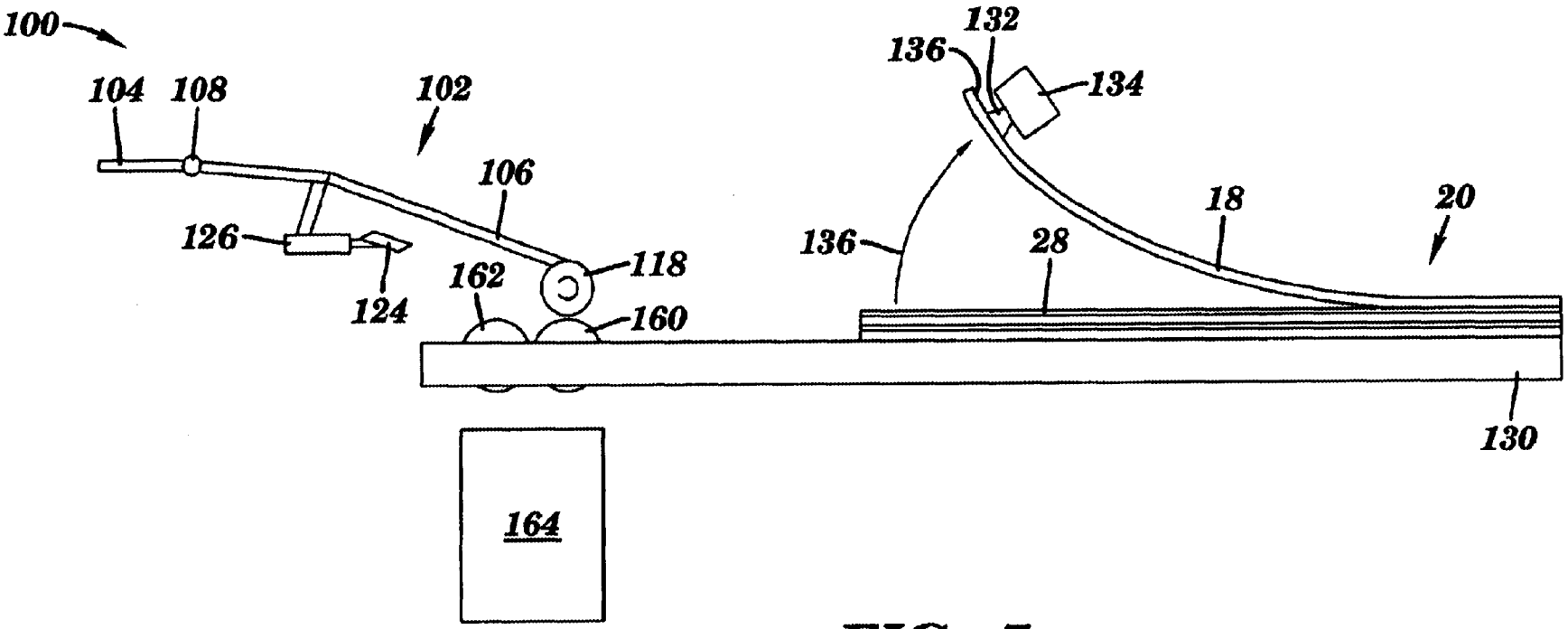

As illustrated in FIG. 7, the end of the top printing plate 18 is partially lifted off of the stack 20, exposing a portion of the underlying slip sheet 28, by displacing the plate picker 134 in the direction indicated by directional arrow 136. The displacement of the plate picker 134 is halted after a sufficient portion of the underlying slip sheet 28 has been exposed. The plate picker 134 holds the top printing plate 18 in this position until the slip sheet 28 has been captured by the slip sheet removal system 100. The amount of displacement required to expose a sufficient portion of the underlying slip sheet 28 depends on many application specific factors including, for example, the size and material of the printing plates 18, the size and specific configuration of the slip sheet removal system 100, etc. Alternately, the top printing plate 18 can be completely removed from the stack 20 prior to the removal of the underlying slip sheet 28.

Figure 8:
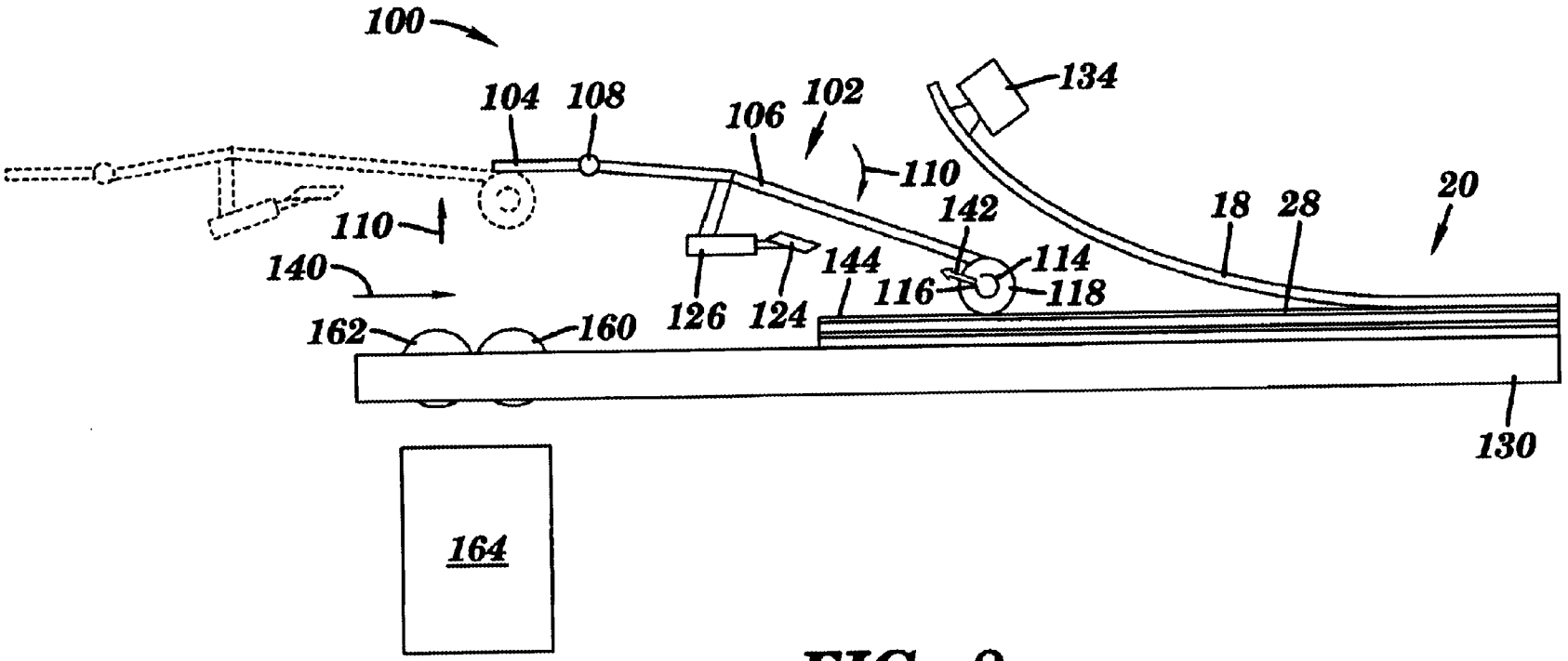
Figure 9:
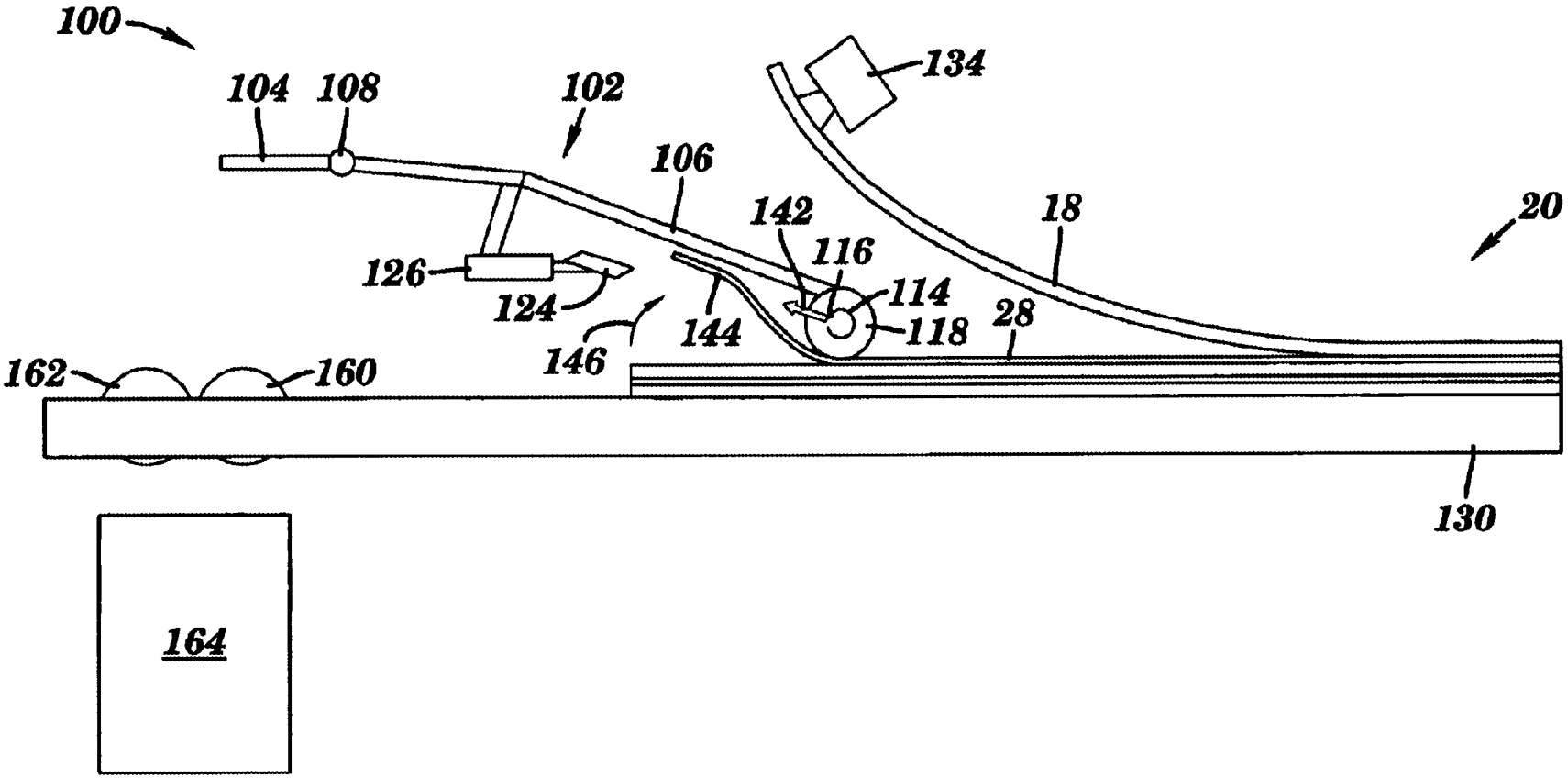

The slip sheet removal system 100 is displaced as indicated by directional arrow 140 toward and over the slip sheet 28 on the stack 20 as illustrated in FIG. 8. Prior to being laterally displaced toward the stack 20, the second section 106 of the wing 102 is rotated about the hinge 108 in direction 110 by the drive system 112 (FIG. 3) from the slip sheet capture position into the horizontal position (shown in phantom). This reduces the overall height of the slip sheet removal system 100 and the corresponding space required to accommodate the slip sheet removal system 100 as it travels toward the stack 20. The displacement of the slip sheet removal system 100 in direction 140 (and direction 152, FIG. 12) may be provided using pneumatic cylinders, a motor, or any other suitable type of drive system 200 (FIG. 5). When the idler rollers 118 of the slip sheet removal system 100 are positioned over the slip sheet 28, the second section 106 of the wing 102 is rotated downward about the hinge 108 in direction 111 by the drive system 112 (FIG. 4) from the horizontal position to the slip sheet capture position until the idler rollers contact the surface of the slip sheet 28.

Compressed air is supplied to the air manifold 114 after the second section 106 of the wing 102 reaches the slip sheet capture position. The high velocity streams of air 142 flowing out of the orifices 116 of the air manifold 114 are directed along the underside of the second section 106 of the wing 102. The streams of air create a zone of reduced pressure directly under the second section 106 of the wing 102, due to the Bernoulli effect, which causes the end section 144 of the slip sheet 28 that is positioned under the second section 106 of the wing 102 to lift away from the stack 20 as indicated by directional arrow 146 in FIG. 9. The length of the end section 144 of the slip sheet 28 is defined by the position of the idler rollers 118 on the slip sheet 28. The higher pressure under the lifted end section 144 of the slip sheet 28 forces the slip sheet 28 toward the underside of the second section 106 of the wing 102. The slip sheet 28 is held in this position as long as the air flow through the orifices 116 of the air manifold 114 continues.

Figure 10:
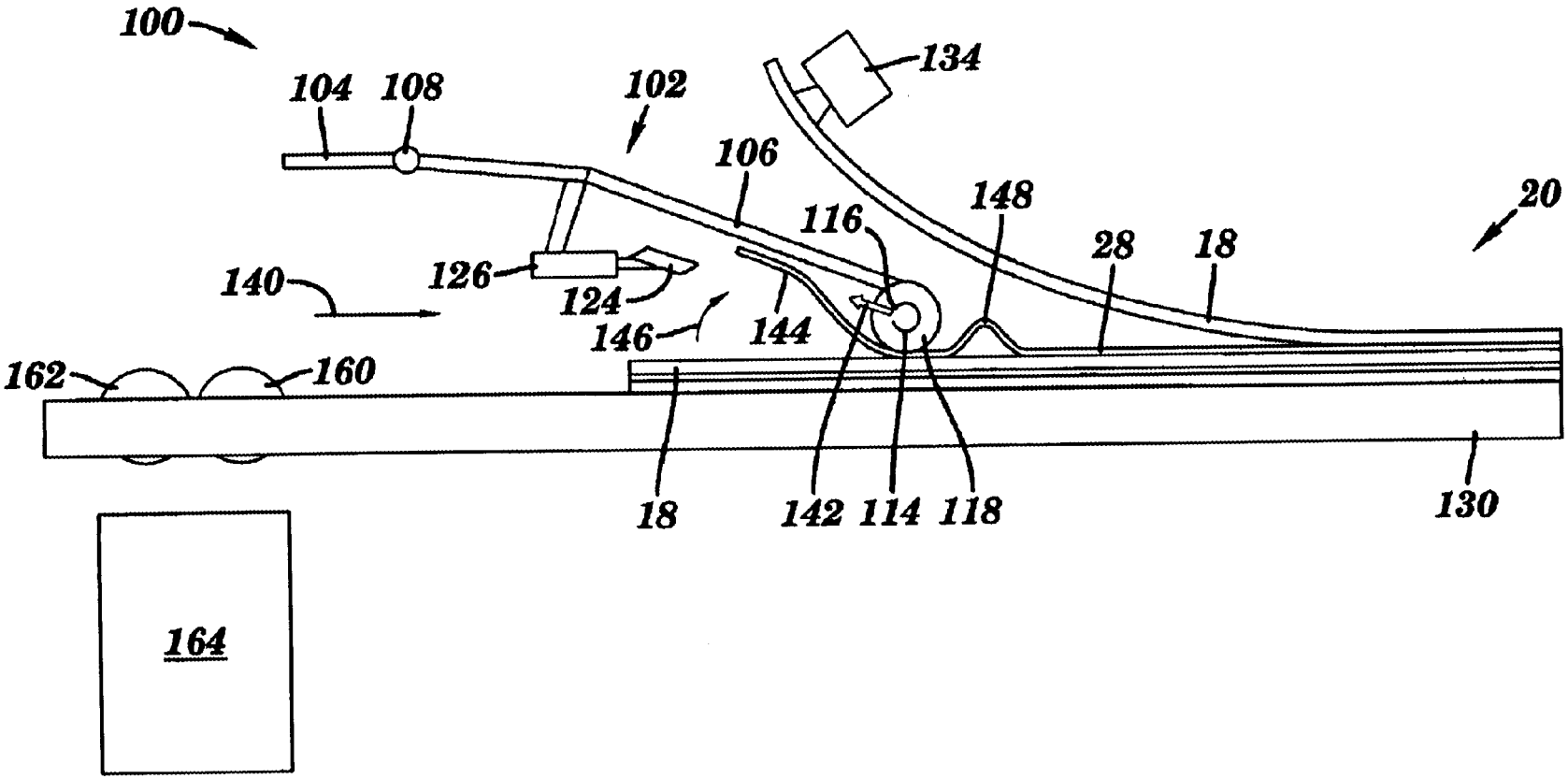

The displacement of the slip sheet removal system 100 may continue along direction 140 for a short distance after the initial contact of the idler rollers 118 against the slip sheet 28. During this additional displacement, compressed air is supplied to the air manifold 114. As shown in FIG. 10, the continued displacement of the slip sheet removal system 100 loosens and separates the end section 144 of the slip sheet 28 from the underlying printing plate 18 in the stack 20, and forms a slight bulge 148 in the slip sheet 28. The loosening/separating step may be necessary, for example, if the adhesion between the slip sheet 28 and the underlying printing plate 18 is greater than the lift provided by the streams of air flowing along the underside of the second portion 106 of the wing 102.

Figure 11:
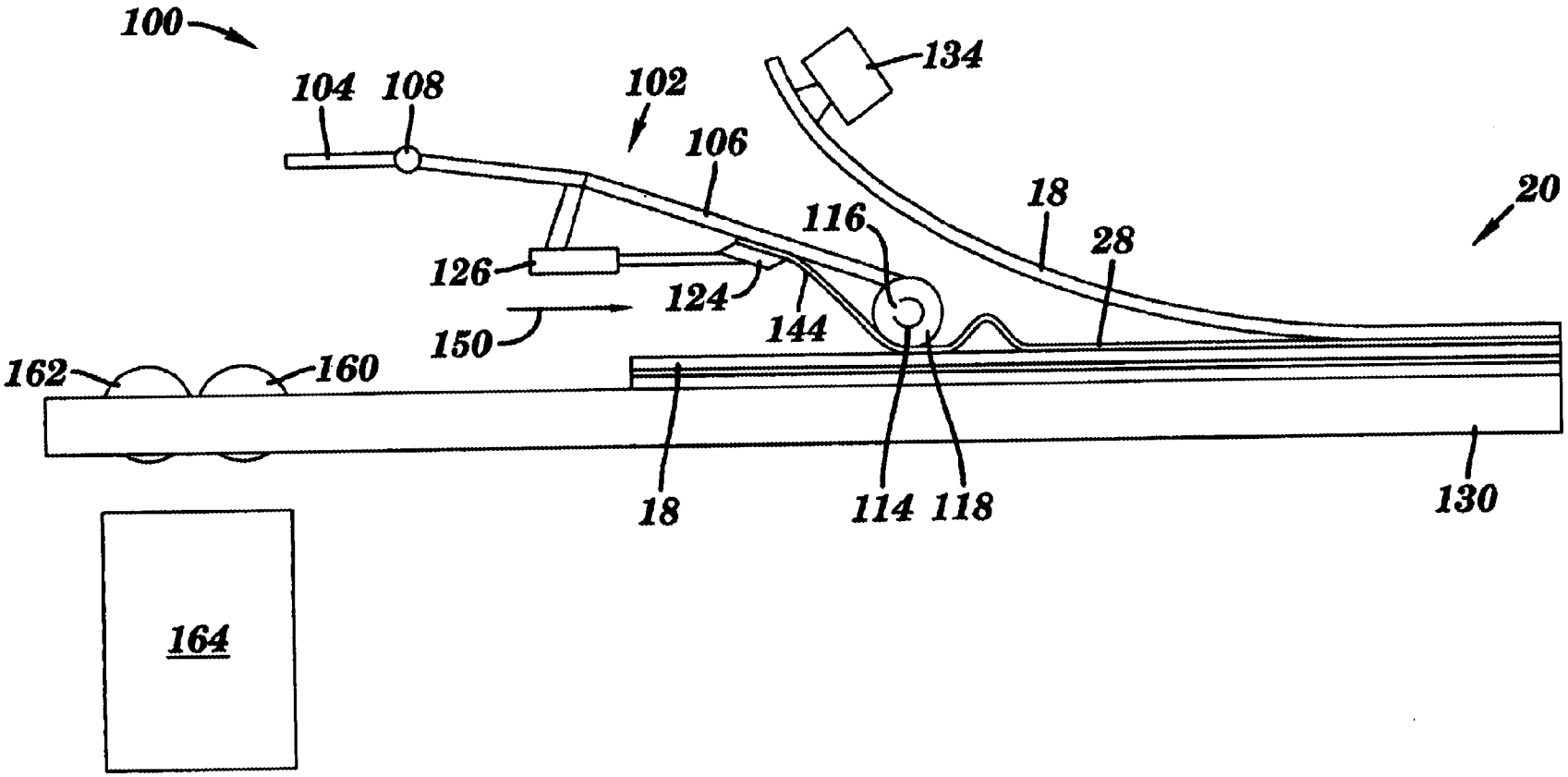
Figure 12:
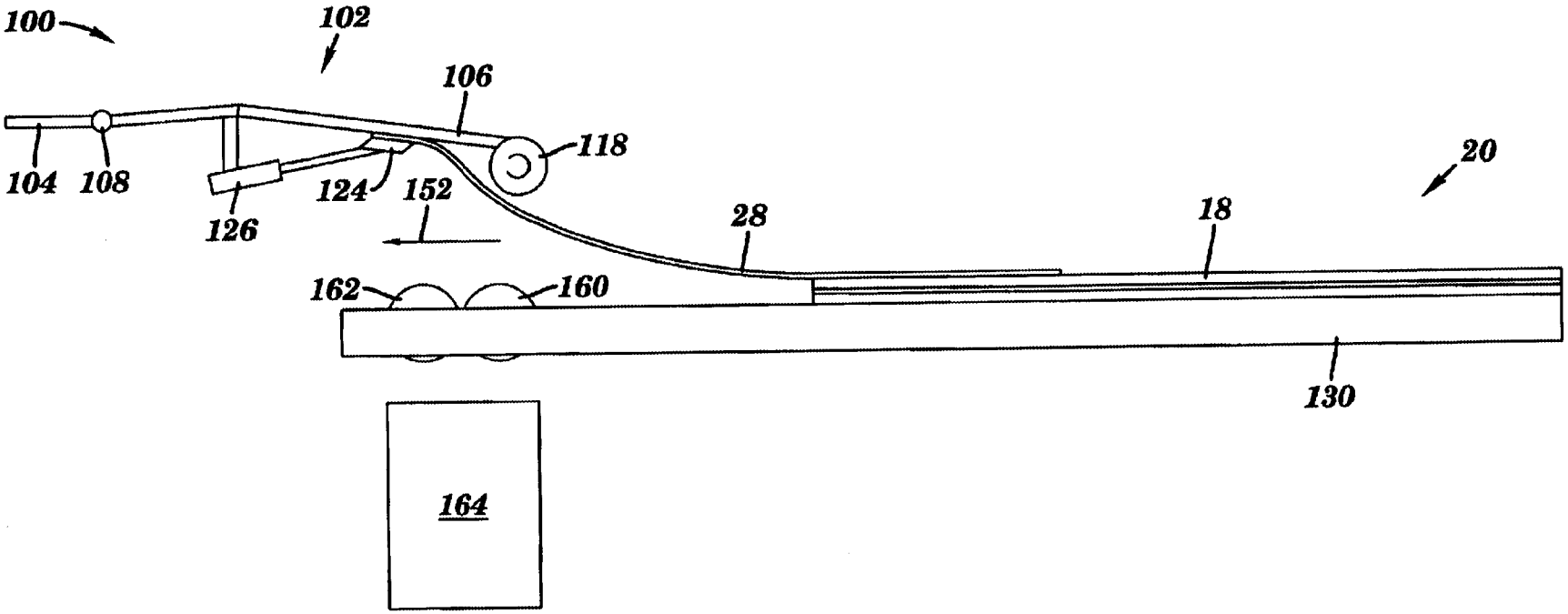

As shown in FIG. 11, the end section 144 of the slip sheet 28 is subsequently pinched against the underside of the second section 106 of the wing 102 by the clamping bar 124. The clamping bar 124 is extended toward the wing 102 as indicated by directional arrow 150 by the pneumatic cylinders 126. The slip sheet 28 is now under the physical control of the slip sheet removal system 100. At this point, the streams of air 142 flowing out of the orifices 116 of the air manifold 114 are no longer required, and the compressed air supply 120 can be shut off. The top printing plate 18 held by the plate picker 134 can now be removed from the stack 20, and loaded onto the external drum 24 (FIG. 1) for imaging.

Figure 13:
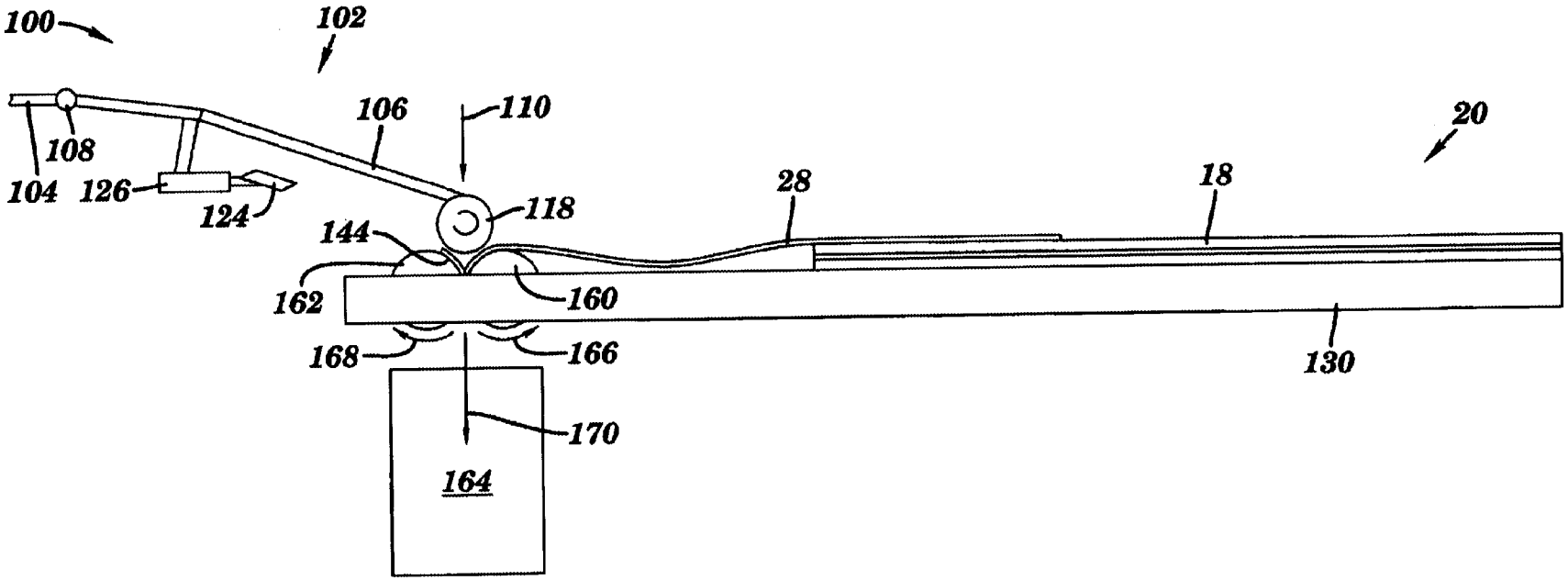

The captured slip sheet 28 is removed from the stack 20 by laterally displacing the slip sheet removal system 100 away from the stack 20 using drive system 200. This displacement is indicated by directional arrow 152 in FIG. 12. Prior to displacement in direction 152, the second section 106 of the wing 102 is rotated upward about the hinge 108 from the slip sheet capture position to the horizontal position. The slip sheet removal system 100 is displaced along direction 152 until the idler rollers 118 are positioned near the drive rollers 160. As illustrated in FIG. 13, the second section 106 of the wing 102 is then rotated downward about the hinge 108 in direction 110 from the horizontal position to the slip sheet capture position to pinch the slip sheet 28 between the idler rollers 118 and the drive rollers 160, 162. At this time, the clamping bar 124 is retracted by the pneumatic cylinders 126, thereby freeing the end section 144 of the slip sheet 28. The drive rollers 160, 162, which are rotated in opposite directions 166, 168, pull the slip sheet 28 downward into the bin 162 for collection as indicated by directional arrow 170. The process described with reference to FIGS. 6–13 is repeated as necessary to remove and collect all of the slip sheets 28 in the stack 20.

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention.

What is claimed is:

1. An apparatus for removing a slip sheet from a surface of a printing plate, comprising:

a wing for covering an end section of the slip sheet;

an air manifold coupled to an end of the wing, the air manifold including a plurality of orifices for directing streams of air along an underside of the wing to lift the end portion of the slip sheet off of the printing plate and toward the underside of the wing;

a plurality of idler rollers rotatably mounted about the air manifold; and a clamping bar mounted to the wing for selectively pinching the lifted end section of the slip sheet against the underside of the wing, thereby capturing the slip sheet.

2. The apparatus of claim 1, wherein the idler rollers contact a surface of the slip sheet, and wherein a position of the idler rollers on the slip sheet defines a length of the end portion of the slip sheet.

3. The apparatus of claim 1, wherein the wing further comprises:

first and second sections; and a hinge for rotatably coupling the second section of the wing to the first section of the wing.

4. The apparatus of claim 3, wherein the end portion of the slip sheet is lifted toward an underside of the second section of the wing by the streams of air.

5. The apparatus of claim 3, further comprising:

a drive system for selectively rotating the second section of the wing about the hinge.

6. The apparatus of claim 5, wherein the second section of the wing is rotated by the drive system between a substantially horizontal position and a slip sheet capture position.

7. The apparatus of claim 6, further comprising:

a wing drive system for laterally displacing the wing toward and away from the slip sheet, wherein the wing is in the substantially horizontal position during displacement.

8. The apparatus of claim 6, wherein the idler rollers contact a surface of the slip sheet when the wing is in the slip sheet capture position.

9. The apparatus of claim 1, further comprising:

a collection bin; and a roller system for transferring a slip sheet captured by the wing into the collection bin.

10. The apparatus of claim 9, wherein the clamping bar releases the captured slip sheet prior to the slip sheet being transferred into the collection bin by the roller system.

11. The apparatus of claim 1, further comprising:

a plate picker for partially lifting a printing plate off of the slip sheet to expose a portion of the slip sheet; and a drive system for displacing the wing over the exposed portion of the slip sheet.

12. The apparatus of claim 1, further comprising:

a drive system for displacing the wing away from the printing plate to pull the captured slip sheet off of the printing plate.

13. The apparatus of claim 1, wherein the idler rollers contact a surface of the slip sheet, further comprising:

a drive system for displacing the idler rollers to loosen the slip sheet from the printing plate.

14. An apparatus for removing a slip sheet from a surface of a printing plate, comprising:

a wing having first and second rotatably coupled sections;

a wing drive system for laterally displacing the wing to position the second section of the wing over an end section of the slip sheet;

an air manifold coupled to an end of the second section of the wing, the air manifold including a plurality of orifices for directing streams of air along an underside of the second section of the wing to lift the end portion of the slip sheet off of the printing plate and toward the underside of the second section of the wing;

a plurality of idler rollers rotatably mounted about the air manifold; and a clamping bar for selectively pinching the lifted end section of the slip sheet against the underside of the second section of the wing, thereby capturing the slip sheet.

15. The apparatus of claim 14, further comprising:

a drive system for selectively rotating the second section of the wing relative to the first section of the wing.

16. The apparatus of claim 15, wherein the drive system rotates the second section of the wing between a substantially horizontal position and a slip sheet capture position.

17. The apparatus of claim 16, wherein the second section of the wing is in the substantially horizontal position during displacement of the wing by the wing drive system.

18. The apparatus of claim 16, wherein the idler rollers contact a surface of the slip sheet when the wing is in the slip sheet capture position.

19. The apparatus of claim 18, wherein a position of the idler rollers on the slip sheet defines a length of the end portion of the slip sheet.

20. The apparatus of claim 18, wherein the wing drive system displaces the idler rollers to loosen the slip sheet from the printing plate.

21. The apparatus of claim 14, wherein the wing drive system displaces the wing away from the printing plate to pull the captured slip sheet off of the printing plate.

22. The apparatus of claim 21, further comprising:

a collection bin; and a roller system for transferring a slip sheet pulled off the printing plate by the wing into the collection bin.

23. A method for removing a slip sheet from a surface of a printing plate, comprising:

providing a wing having an air manifold, wherein the air manifold includes a plurality of orifices, and wherein a plurality of idler rollers are rotatably mounted about the air manifold;

displacing the wing over an end portion of the slip sheet;

displacing the idler rollers into contact with a surface of the slip sheet;

directing streams of air along an underside of the wing to lift the end portion of the slip sheet off of the printing plate and toward the underside of the wing; and clamping the lifted end portion of the slip sheet against the underside of the wing.

24. The method of claim 23, further comprising:

displacing the wing away from the printing plate to pull the captured slip sheet off of the printing plate.

25. The method of claim 24, further comprising:

releasing the slip sheet; and displacing the released slip sheet into a bin.

26. The method of claim 23, wherein the wing comprises first and second rotatably coupled sections, further comprising:

rotating the second section of the wing between a substantially horizontal position and a slip sheet capture position, wherein the idler rollers contact the surface of the slip sheet when the wing is in the slip sheet capture position.

27. The method of claim 23, further comprising:

displacing the idler rollers to loosen the slip sheet from the printing plate.

* * * * *